United States Patent [19]

Tandon et al.

[11] 4,305,583

[45] Dec. 15, 1981

[54] PLAY BALL

[75] Inventors: Ravi Tandon, Manchester; John G. Schofield, Dodworth Barnsley, both of England

[73] Assignee: Dunlop Limited, London, England

[21] Appl. No.: 167,007

[22] Filed: Jul. 9, 1980

[30] Foreign Application Priority Data

Jul. 19, 1979 [GB] United Kingdom ..... 25194/79

[51] Int. Cl.[3] ..... A63B 39/02; A63B 39/06

[52] U.S. Cl. ..... 273/61 R; 273/58 E

[58] Field of Search ..... 273/61 R, 61 A, 61 B, 273/61 C, 61 D, 65 R, 58 B, 58 BA, 58 E

[56] References Cited

U.S. PATENT DOCUMENTS 2,131,756 10/1938 Roberts ..... 273/61 R
2,210,954 8/1940 Roberts ..... 156/161

FOREIGN PATENT DOCUMENTS 148794 9/1951 Australia ..... 273/61 R
738777 11/1973 South Africa .
702174 1/1954 United Kingdom .
719464 12/1954 United Kingdom .
719467 12/1954 United Kingdom .
887535 1/1962 United Kingdom .
1214389 12/1970 United Kingdom .
2001538A 2/1979 United Kingdom .
1543871 4/1979 United Kingdom .

*Primary Examiner*—George J. Marlo
*Attorney, Agent, or Firm*—Stevens, Davis, Miller & Mosher

[57] ABSTRACT

The invention relates to playballs, e.g. tennis balls, having a core pressurized with a low permeability gas, e.g. sulphur hexafluoride. Use of such gases can cause the ball to emit a pinging noise on bouncing. The invention provides a core (1) pressurized with gas of low permeability, the internal wall surface (3) of core (1) being profiled by a multiplicity of depressions or protuberances (4), the outer wall surface (2) of the core being smooth. The profiling is preferably in the form of dimples or pimples of circular plan view.

12 Claims, 4 Drawing Figures

PLAY BALL

Figure 1:
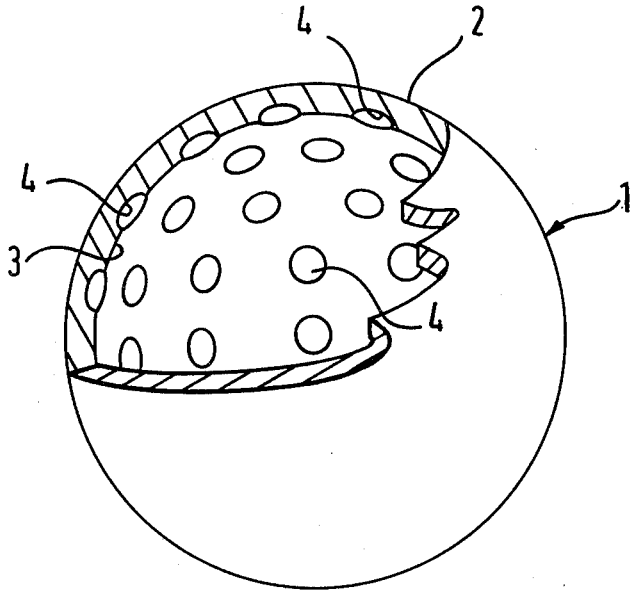

This invention relates to pressurised play balls, i.e. play balls made with a rubber core inflated with a gas at a super-atmospheric pressure. It is particularly concerned with tennis balls but is not limited thereto and is applicable, for example, to Racquet balls.

It is well known that pressurised play balls gradually lose pressure over a period of a few months until they eventually become unsatisfactory for use. This occurs due to the permeation of the inflating gas through the wall of the ball and one method of overcoming this disadvantage is to store the balls inside pressurised containers until they are required for use. While this is in fact normal current procedure, storage in this way is both inconvenient and costly.

An alternative method of overcoming the basic problem of loss of pressure is to produce balls which do not need internal pressurisation. Non-pressurised tennis balls have never been universally accepted by good tennis players due to certain shortcomings in their performance and there is therefore a need for an improved pressurised tennis ball which can be stored for long periods of time without the necessity for special pressurised packaging.

It is known that certain gases when used for inflating balls permeate through the ball wall more slowly than either air or nitrogen, which are conventionally used for inflation purposes. These slow permeators are basically gases of relatively large molecular size and/or complex molecular geometry. One gas which appears to offer an advantage in this respect is sulphur hexafluoride ($SF_6$) and also mixtures of this gas with air or nitrogen.

Certain other gases also show a similar advantage in reduced rate of pressure loss, for example perfluoropropane ($C_3F_8$) and $Cl_2CFCF_3$. Use of such slow permeating gases in pressurised play balls has been described in British Pat. No. 1,543,871 and South African Pat. No. 73/8777.

However, one significant disadvantage has been found in using gases of relatively large molecular size in that, on bouncing, balls so inflated often exhibit a significant high-pitched noise which can be disturbing to players. This is particularly so in tennis when players bounce the tennis ball on the court surface immediately prior to serving at a time when their mental concentration must not be subject to distraction.

It would appear that the high-pitched noise is a condition of resonance of the core and its inflation gas and the fact that the nature of the gas is found in certain circumstances to promote this resonant condition is thought to be due to the interaction of the internal dimensions of the core and the wavelength of vibrations produced in the gas by the deformation of the core and its subsequent vibrations after bouncing. (By 'core' herein is meant a hollow elastomeric sphere which may be either the well-known core of a tennis ball or the complete ball of, say, a Racquetball ball).

Be that as it may, we have found that if the internal surface of the core is given a profiled, rather than a smooth surface, then the high-pitched noise is reduced or eliminated.

The present invention accordingly provides a play ball comprising a hollow elastomeric sphere pressurised with a gas of low permeability, the internal wall surface of the sphere being profiled by a multiplicity of depressions or protuberances but the outer wall surface of the sphere being substantially smooth.

As indicated above, the invention is of particular relevance to tennis balls and so for convenience will hereafter be described with particular reference to tennis balls.

Although it is not intended to limit the invention to any particular theory, it is thought that the reduction or elimination of the high-pitched noise referred to above may be due to the following reasons:

During the local deformation of the ball on bouncing, compression waves are set up in the inflation gas which are reflected back and forth across the inside of the core and under certain conditions standing waves will be produced which give rise to the high-pitched noise. Such effects are well known in relation, for instance, to organ pipes in which the length of the organ pipe determines the frequency of the vibration of the air contained within it and where the closed end of the organ pipe causes compression waves to be reflected and standing waves to be set up.

In the case of an article such as a tennis ball core the considerations are altogether more complex.

The frequencies of the standing waves are determined by the internal dimensions of the core and the molecular weight of the gas contained therein. Also the core itself vibrates and has a resonant frequency which is determined by the rubber composition of which it is formed, the thickness of the wall of the core and the pressure of the inflating gas.

Under certain circumstances, if one of the standing wave frequencies in the gas coincides with one of the core vibration frequencies, reinforcement will occur giving rise to a resonant condition for the core/gas system which is evidenced by large amplitude vibration at that frequency. The vibrations will exist for a finite time due to the conditions of resonance and will be clearly audible.

The addition of, say, dimples or pimples to the inner surface of the core alters the effective internal diameters of the core measured through different points on the internal surface of the core. This will have the effect of producing more complicated internal reflections so that the formation of standing waves inside the core is inhibited and the likelihood of a resonant condition being produced is minimised.

A secondary effect of the dimples or pimples may be that the stresses induced in the core wall when the ball is bounced and which govern the vibration of the core itself are modified by the varying effective thickness of the wall of the core and so the resonant frequency of the core itself is changed to a value that is less critical in relation to the frequency of the standing waves generated inside. The vibration induced in the system on bouncing the ball therefore dies away much more quickly and so is less audible and under certain circumstances, no undesirable high-pitched sound is produced whatsoever.

It should be pointed out that normally the internal surface of the core of a tennis ball is made as smooth as possible for the following reasons:

(1) The wall thickness should be as uniform as possible so that uniform bounce is obtained.

(2) Stress concentrations leading to wall failure could occur under certain conditions of non-uniformity.

(3) The core is usually made by assembling together two half-cores. The half-cores are made by a compression moulding process and difficulty could be experienced in removing the half-core from the mould if it had a profiled surface.

(4) The necessary profiled surface of a half-core mould would be more difficult to clean than that of a mould with a smooth surface. This is due to the build-up of residues that occur during the moulding process.

The above points (1) to (4) indicate why in normal practice half-core moulds have smooth insides. However, if necessary, and despite the possible disadvantages, internal profiled surfaces can be specified which provide advantages in avoiding resonance as previously indicated, but which minimise other problems.

As suggested previously, the multiplicity of protuberances or depressions produces a highly non-uniform reflecting surface so that standing waves are avoided.

The depressions or protuberances are preferably a large number, e.g. from 40 to 400, especially from 80 to 150, of dimples or pimples and these are preferably uniformly distributed.

The profiled inner surface of the core can be obtained in ways other than by dimpling or pimpling. For instance, the profiling may be produced by incorporating a number of ridges, grooves or blocks on the internal surface or by producing indentations or protuberances of varied shape and distribution. From these considerations of practical manufacture however, dimples or pimples are generally preferred particularly when it is considered that they allow complex reflection of sound waves and yet affect the weight of the core least. This is an important factor because in addition to the other important properties of a tennis ball, i.e. rebound, compression (or hardness) and size, weight must be held within strictly controlled limits.

Normally between 10% and 90% of the internal surface area should be constituted by, e.g. dimples or pimples, and preferably between 25% and 75%. The dimples or pimples are preferably of circular appearance in plan view, their shape being that of a solid of revolution generated by the rotation of a plane curve about a radius of the core, such as a segment of a sphere or an ellipsoid, but this is by no means essential. Their dimensions are not critical but preferably the ratio of diameter to depth/height should be as large as possible and preferably equal to or greater than 2:1. Preferred dimple or pimple diameters are from 3.0 mm to 8.0 mm, e.g. 6.0 mm and preferred depths or heights are from 1.0 mm to 3.0 mm, e.g. 1.5 mm. Whichever type of depression or protuberance is utilised, it is preferred that its height or depth should not be greater than 3.0 mm (0.125 inch) from the internal surface level of the core for a core of thickness (excluding any depression or protuberance) of 3.3 to 3.7 mm.

The following factors should be taken into consideration when determining the degree of profiling that may be used with advantage for any particular circumstances.

1. A generally roughened or pitted surface would not be suitable because it would render the mould extremely difficult to clean.
2. The texture must therefore be in the form of a number of distinct indentations or protuberances.
3. The weight limitations on the ball core will be an overriding factor as to the total volume of indentations or protuberances that can be tolerated.
4. Other than fairly regular curved shapes of indentations or protuberances may not be satisfactory for two reasons:
   (a) any undercuts would lead to difficulties in removal from the mould,
   (b) any sharp angles could lead to undesirable stress in the product.
5. The depth of any indentation will be limited by the requirement to maintain a minimum strength based on a minimum wall thickness.

The tennis ball core may be moulded from any conventionally-used elastomeric material and may be covered with, e.g. melton or needled-punched fabric.

The initial internal pressure of the tennis balls is preferably in the range of 10 to 12 p.s.i. and the balls should meet the specification as laid down by the International Lawn Tennis Federation:

Diameter—"Go-No Go" gauge 2.575" to 2.700" (65.4–68.6 mm)

Weight: 2.0–2 1/16 oz (56.70–58.47 gm)

Rebound from 100" onto concrete 53–58" (1.35–1.47 m)

Deformation under 18 lb f (8.2 Kgf) load 0.230–0.290 in (5.85–7.35 mm)

Deformation under 18 lb f (8.2 Kgf) load on recovery after ball has been compressed through 1". (2.54 cm) 0.355–0.425 in (9–10.8 mm).

Figure 2:
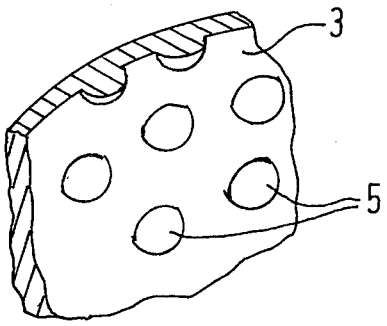
Figure 3:
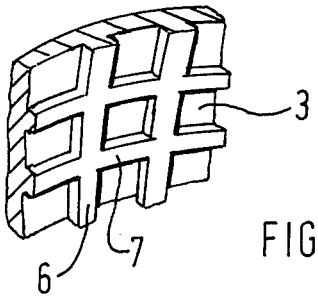
Figure 4:
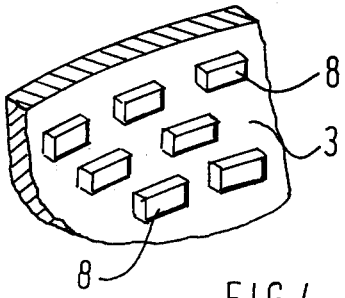

Various embodiments of the invention are illustrated by way of example only in the accompanying drawings in which:

FIG. 1 shows a tennis ball core with part of the wall removed to show the internal configuration according to one embodiment of the invention, FIG. 2 shows a fragment of the wall of a tennis ball core, partly in section, showing an alternative embodiment of the invention, FIG. 3 is a similar view to FIG. 2 of a further embodiment of the invention, and FIG. 4 is a similar view to FIG. 2 and FIG. 3 of a yet further embodiment of the invention.

FIG. 1 shows a hollow tennis ball core 1 having a smooth, indentation-free outer surface 2 and a dimpled inner surface 3. The dimples 4 formed in inner surface 3 of the core are uniformly distributed over surface 3 and are circular in plan form. Their shape as seen in cross-section is that of a solid of revolution generated by the rotation of a plane curve about a radius of the core.

The wall thickness of the core measured between dimples, i.e. in an undimpled area of the core, was 3.5 mm and the dimples were 7 mm in diameter and 2.5 mm in depth. Eighty-two dimples of this size and shape are uniformly distributed over the inner surface of the core whose internal diameter, again measured between dimples, was 52.5 mm. Hence 27% of the surface area of the interior of the core was constituted by the dimples.

When filled with $SF_6$ to a pressure of 12 p.s.i. the core was covered with a conventional melton and used as a tennis ball. No noticeable 'pinging' noise was detected. A similar size core of the same material when similarly inflated with $SF_6$ and similarly covered resulted in a tennis ball emitting a distinct 'pinging' noise on bouncing.

FIG. 2 shows an alternative embodiment in which instead of dimples, pimples 5 are uniformly distributed over the inner surface 3 of the core.

In FIG. 3 the indentations or protuberances are in the form of ridges 6 and 7 standing proud of surface 3 and in FIG. 4 blocks 8 are uniformly distributed around and stand proud of surface 3.

Having now described our invention, what we claim is:

1. A playball comprising a hollow elastomeric sphere pressurised with a gas which permeates through the walls of said sphere slower than air or nitrogen, said sphere including an internal wall surface profiled by a multiplicity of dimples or pimples, and an outer wall surface which is substantially smooth.

2. A playball according to claim 1, in which said pressurising gas is $SF_6$, $C_3F_8$ or $Cl_2CFCF_3$.

3. A playball according to claim 1, in which there are from 40 to 400 of said dimples or pimples uniformly distributed throughout said internal surface.

4. A playball according to claim 3, in which there are from 80 to 150 of said dimples or pimples uniformly distributed.

5. A playball according to any one of claims 1, 2 or 3 in which from 10% to 90% of the surface area of said internal wall of said sphere is constituted by said dimples or pimples.

6. A playball according to claim 5, in which from 25% to 75% of the surface area of said internal wall of the sphere is constituted by said dimples or pimples.

7. A playball according to claims 1, 2 or 3, in which the shape of said dimples or pimples is that of a solid of revolution generated by the rotation of a plane curve about a radius of the sphere.

8. A playball according to claims 1, 2 or 3, in which the ratio of diameter to depth or diameter to height of said dimples or pimples respectively is equal to or greater than 2:1.

9. A playball according to claim 8 in which the diameters of said dimples or pimples are from 3.0 to 8.0 mm and their depths or heights are from 1.0 mm to 3.0 mm.

10. A playball according to claim 1, which is a tennis ball, said sphere constituting the core of the ball.

11. A tennis ball according to claim 10, in which the wall thickness of said core excluding any dimple or pimple is from 3.3 to 3.7 mm and the depths or heights of the dimples or pimples are not greater than 3.0 mm.

12. A playball comprising a hollow elastomeric sphere pressurized with a gas which permeates through the walls of said sphere slower than air or nitrogen, said sphere including an internal wall surface profiled by a multiplicity of dimples or pimples for reducing or eliminating noise generated within the sphere when said playball is bounced, and an outer wall surface which is substantially smooth.

* * * * *